US007727124B1

(12) United States Patent
Lassanske et al.

(10) Patent No.: US 7,727,124 B1
(45) Date of Patent: Jun. 1, 2010

(54) FOLDABLE AND CAMMING PIVOT MOUNT FOR A RESISTANCE UNIT IN A BICYCLE TRAINER

(75) Inventors: Todd W. Lassanske, Madison, WI (US); Benjamin R. Bass, Madison, WI (US); Randy J. Hilgart, Cottage Grove, WI (US)

(73) Assignee: Saris Cycling Group, Inc., Madison, WI (US)

( * ) Notice: Subject to any disclaimer, the term of this patent is extended or adjusted under 35 U.S.C. 154(b) by 16 days.

(21) Appl. No.: 12/116,001

(22) Filed: May 6, 2008

(51) Int. Cl.
*A63B 69/16* (2006.01)

(52) U.S. Cl. ..... 482/61; 482/65

(58) Field of Classification Search ..... 482/51, 482/57, 60, 61, 62, 63, 64, 65
See application file for complete search history.

(56) References Cited

U.S. PATENT DOCUMENTS

| | | | | |
|---|---|---|---|---|
| 3,724,844 | A * | 4/1973 | Olmstead et al. | 482/61 |
| 5,728,029 | A * | 3/1998 | Minoura | 482/61 |
| 5,944,637 | A | 8/1999 | Stickler et al. | |
| 6,162,152 | A * | 12/2000 | Kuo | 482/63 |
| 6,488,611 | B1 | 12/2002 | Ambrosina et al. | |
| 6,527,681 | B2 * | 3/2003 | Tacx | 482/61 |
| 6,620,081 | B2 * | 9/2003 | Phillips | 482/57 |
| 6,702,721 | B2 * | 3/2004 | Schroeder | 482/61 |
| 6,843,758 | B2 * | 1/2005 | Qiu | 482/61 |
| 6,964,633 | B2 | 11/2005 | Kolda et al. | |
| 7,011,607 | B2 | 3/2006 | Kolda et al. | |
| 2009/0075785 | A1 * | 3/2009 | Schroeder | 482/61 |

* cited by examiner

*Primary Examiner*—Loan H Thanh
*Assistant Examiner*—Tam Nguyen
(74) *Attorney, Agent, or Firm*—Boyle Fredrickson, S.C.

(57) ABSTRACT

A bicycle trainer includes a frame and a resistance unit movably interconnected with the frame by an adjustment arrangement for movement through a range of operative positions and to an inoperative position. The adjustment arrangement includes an adjustment member that is selectively engaged with, and disengaged from, an engagement member. When disengaged, the adjustment member slides relative to the engagement member. The sliding movement of the adjustment member provides a first mode of operation to move the resistance unit to an initial engagement position adjacent the wheel, and the adjustment arrangement can be operated in a second mode of operation, such as by cam-type movement, to advance the resistance unit from the initial engagement position toward and against the wheel.

22 Claims, 9 Drawing Sheets

FOLDABLE AND CAMMING PIVOT MOUNT FOR A RESISTANCE UNIT IN A BICYCLE TRAINER

BACKGROUND AND SUMMARY OF THE INVENTION

This invention relates to an exercise device such as a bicycle trainer, and more particularly to a feature for movably mounting a resistance unit to the frame of a bicycle trainer.

A bicycle trainer typically includes a frame that is configured to support the driven wheel of a bicycle, and a resistance unit carried by the frame that is engageable with the bicycle wheel to resist rotation of the wheel upon application of input power to the bicycle pedals by a user. The frame typically includes a main support that carries the resistance unit, and a pair of foldable legs that extend from the main support and which provide stable support for the frame when the frame rests on a supporting surface such as a floor. In the prior art, the resistance unit has been mounted to the trainer using a pivot connection between the trainer frame and the body or yoke of the resistance unit, in combination with an adjustment mechanism that is operated by a user to move the resistance unit about the pivot connection into engagement with the bicycle wheel. Typically, the adjustment mechanism is in the form of a screw-type mechanism that includes a nut that is manually rotated by the user to move the resistance unit toward and away from the bicycle wheel.

In the prior art, due to the geometrical relationship between the resistance unit and the frame, the resistance unit is positioned so as to extend outwardly at an angle relative to the main support of the frame. Because the adjustment mechanism provides a limited range of adjustment in the angular position of the resistance unit relative to the frame, it is not possible to move the resistance unit a sufficient distance to provide a folded configuration of the bicycle trainer when not in use.

In addition, the screw-type adjustment mechanism of prior art bicycle trainers can result in inconsistencies when the resistance unit is moved into engagement with the bicycle wheel. Specifically, because operation of the screw-type adjustment mechanism advances the resistance unit in small increments that cannot easily be visually detected, it is possible for the user to advance the resistance unit so that it engages the tire of the bicycle wheel with different degrees of compression from one use of the bicycle trainer to another. Since the overall resistance provided by the resistance unit is dependent on the degree of compression of the bicycle tire by the resistance unit, this variability in the degree of compression of the tire can result in different operation of the resistance unit from one use to another.

In accordance with one aspect, the present invention contemplates a bicycle trainer for use with a bicycle having a driven wheel, which includes a frame and a resistance unit movably interconnected with the frame for movement through a range of operative positions relative to the frame for engagement with the wheel. The resistance unit is also movable relative to the frame to an inoperative position. A manually operable resistance unit adjustment arrangement is interposed between the resistance unit and the frame. The adjustment arrangement is operable by a user to move the resistance unit throughout the range of operative positions, and also to enable movement of the resistance unit to and from the inoperative position. The resistance unit may be movably interconnected with the frame via a pivot connection between the resistance unit and the frame, and the adjustment arrangement may include an elongated adjustment member interconnected between the resistance unit and the frame at a location spaced from the pivot connection. The adjustment arrangement further includes an engagement member, which is selectively engageable with the adjustment member. The engagement member is pivotably interconnected with one of the resistance unit and the frame for movement about a pivot axis oriented transverse to a longitudinal axis along which the elongated adjustment member extends, and the elongated adjustment member is interconnected with the other of the resistance unit and the frame. The adjustment member is selectively engaged with the engagement member to maintain the resistance unit in a selected operative position. Representatively, the adjustment member may be selectively engaged with the engagement member via threaded areas on the adjustment member and the engagement member. The adjustment member is selectively disengaged from the engagement member so as to provide sliding movement between the adjustment member and the engagement member. Representatively, the adjustment member may be disengaged from the engagement member by means of void areas on the engagement member, which disengage the adjustment member from the threads of the engagement member. In this manner, the adjustment member can be moved axially relative to the engagement member to allow pivoting movement of the resistance unit throughout the range of operative positions, to accommodate differently sized bicycle wheels. When not in use, the resistance unit can be moved to the inoperative position, which may be a folded position relative to the frame. The adjustment member and the engagement member are configured to accommodate and provide such movement of the resistance unit relative to the frame.

In accordance with another aspect, the present invention contemplates a bicycle trainer having a frame and a resistance unit movably interconnected with the frame for movement through a range of operative positions relative to the frame in response to a manually operable resistance unit adjustment arrangement. The adjustment arrangement is operable in a first mode of operation to move the resistance unit to an initial engagement position adjacent the wheel, and is operable in a second mode of operation to advance the resistance unit from the initial engagement position toward and against the wheel. In one embodiment, the elongated adjustment member includes a manually engageable handle. The first mode of operation may be in the form of sliding engagement between the elongated adjustment member and the engagement member, and the second mode of operation may be in the form of cam-type movement of the resistance unit relative to the frame in response to pivoting movement of the handle relative to the elongated adjustment member. With this construction, the user can initially move the resistance unit to a position adjacent or against the tire of the bicycle wheel via the sliding engagement between the elongated adjustment member and the engagement member. The user can then operate the adjustment member so as to fix the axial position of the adjustment member relative to the engagement member, and pivot the handle relative to the elongated adjustment member, which moves the resistance unit a predetermined distance toward and against the tire using cam-type engagement between the handle and the resistance unit. This feature enables the user to maintain consistency in the degree of compression of the bicycle tire from one use of the bicycle trainer to another.

The invention also contemplates methods of altering the configuration of a bicycle trainer, and moving the resistance unit of a bicycle trainer relative to the frame, in accordance with the foregoing summary.

The aspects of the invention may be employed separately, wherein each aspect provides advantages in construction and operation of a bicycle trainer, or may be employed in combination with each other.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
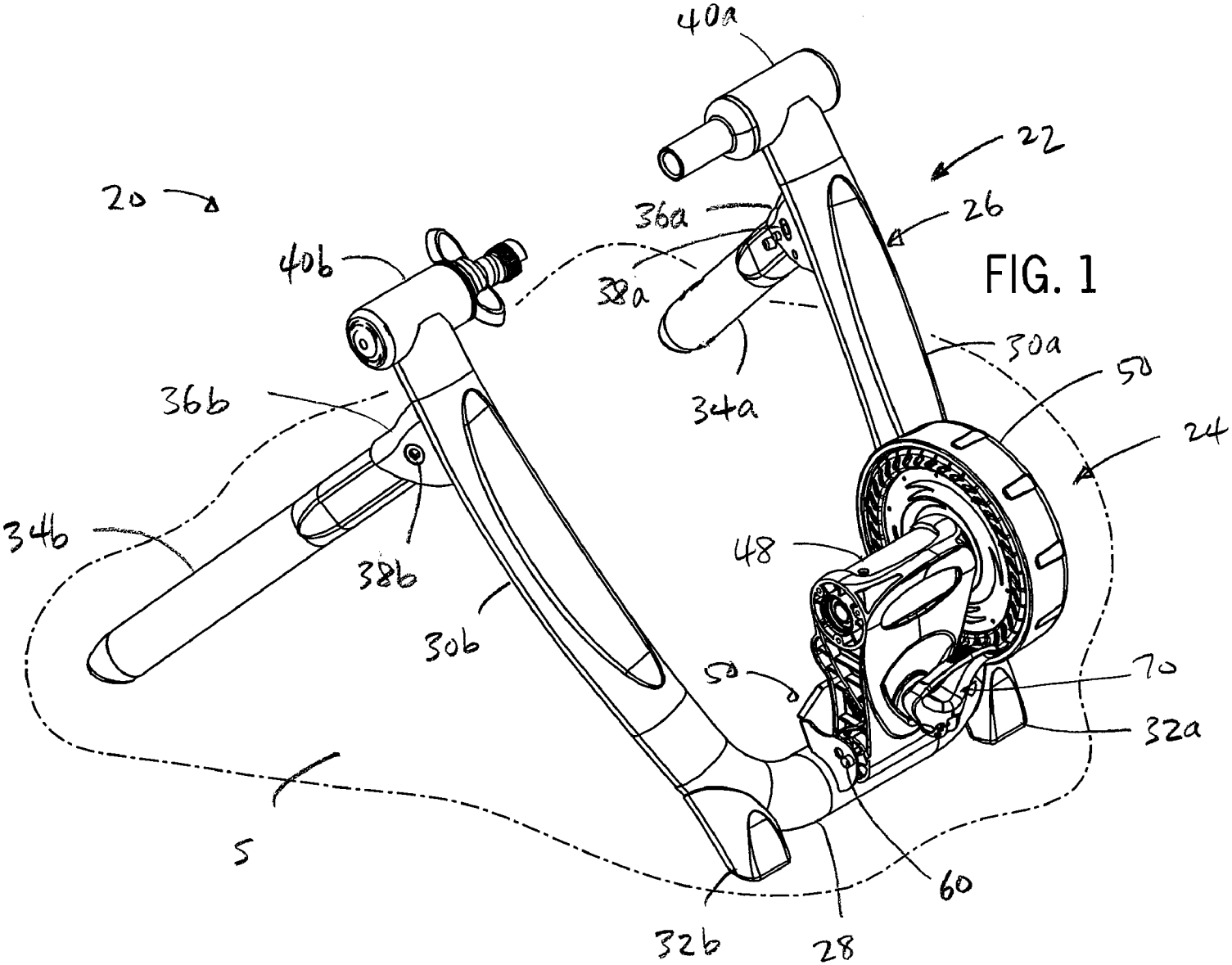
FIG. 1 is an isometric view of a bicycle trainer incorporating the resistance unit adjustment arrangement in accordance with the present invention.

Referring to FIG. 1, a bicycle trainer incorporating a resistance unit mounting feature in accordance with the present invention is generally shown at 20. The bicycle trainer 20 includes a frame generally shown at 22 to which a resistance unit 24 is mounted. In a manner as is known, the resistance unit 24 may provide resistance to rotation of a bicycle wheel using any satisfactory type of resistance arrangement such as, but not limited to, a fluidic, magnetic, electronic, wind or other resistance arrangement. In a manner to be explained, the resistance unit 24 is movably mounted to the frame 22, to enable the resistance unit 24 to be moved into and out of engagement with the bicycle wheel.

The frame 22 is formed of a generally U-shaped main support 26 that defines a base member 28 and a pair of support arms 30*a* and 30*b* that extend upwardly from opposite ends of base member 28. A pair of rear feet, shown at 32*a* and 32*b*, are secured to main support 26 near the intersection of base member 28 and support arms 30*a*, 30*b*, respectively. Feet 32*a*, 32*b* are configured to provide support for the rear area of frame 22 on a support surface S, such as a floor.

A pair of front legs, shown at 34*a*, 34*b*, are secured to support arms 30*a*, 30*b*, respectively. Each front leg 34*a*, 34*b* is preferably mounted to its respective support arm 30*a*, 30*b* by means of a pivot connection, which enables the front legs 34*a*, 34*b* to be moved from an extended position as shown, to a collapsed position for transport and storage. In the collapsed position, the front legs 34*a*, 34*b* are pivoted toward the support arms 30*a*, 30*b*, respectively, so that the front leg 34*a* is generally parallel to the support arm 30*a* and the front leg 34*b* is generally parallel to the support arm 30*b*. In the illustrated embodiment, front legs 34*a*, 34*b* are pivotably secured to respective support arms 30*a*, 30*b* via respective hinge brackets 36*a*, 36*b* and hinge pins 38*a*, 38*b*, although it is understood that any other satisfactory pivotable mounting arrangement may be employed. In a manner as is known, hinge brackets 36*a*, 36*b* are configured to act as stops that limit outward movement of respective front legs 34*a*, 34*b* to the operative extended position as shown in FIGS. 1-3, while enabling front legs 34*a*, 34*b* to be pivoted about respective hinge pins 38*a*,38*b* inwardly to the inoperative collapsed position against respective support arms 30*a*, 30*b*.

Figure 2:
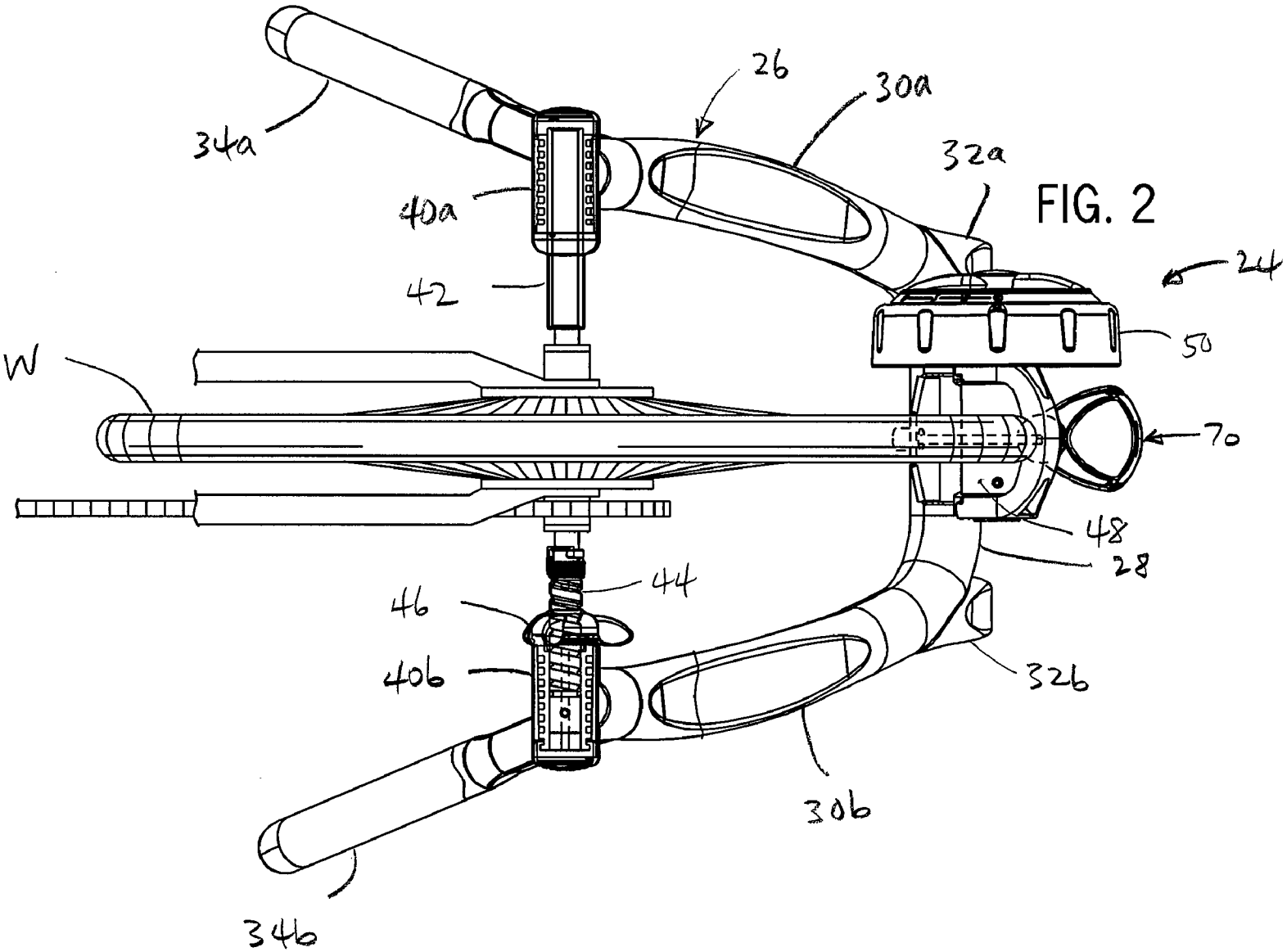
FIG. 2 is a top plan view of the bicycle trainer of FIG. 1.
Figure 3:
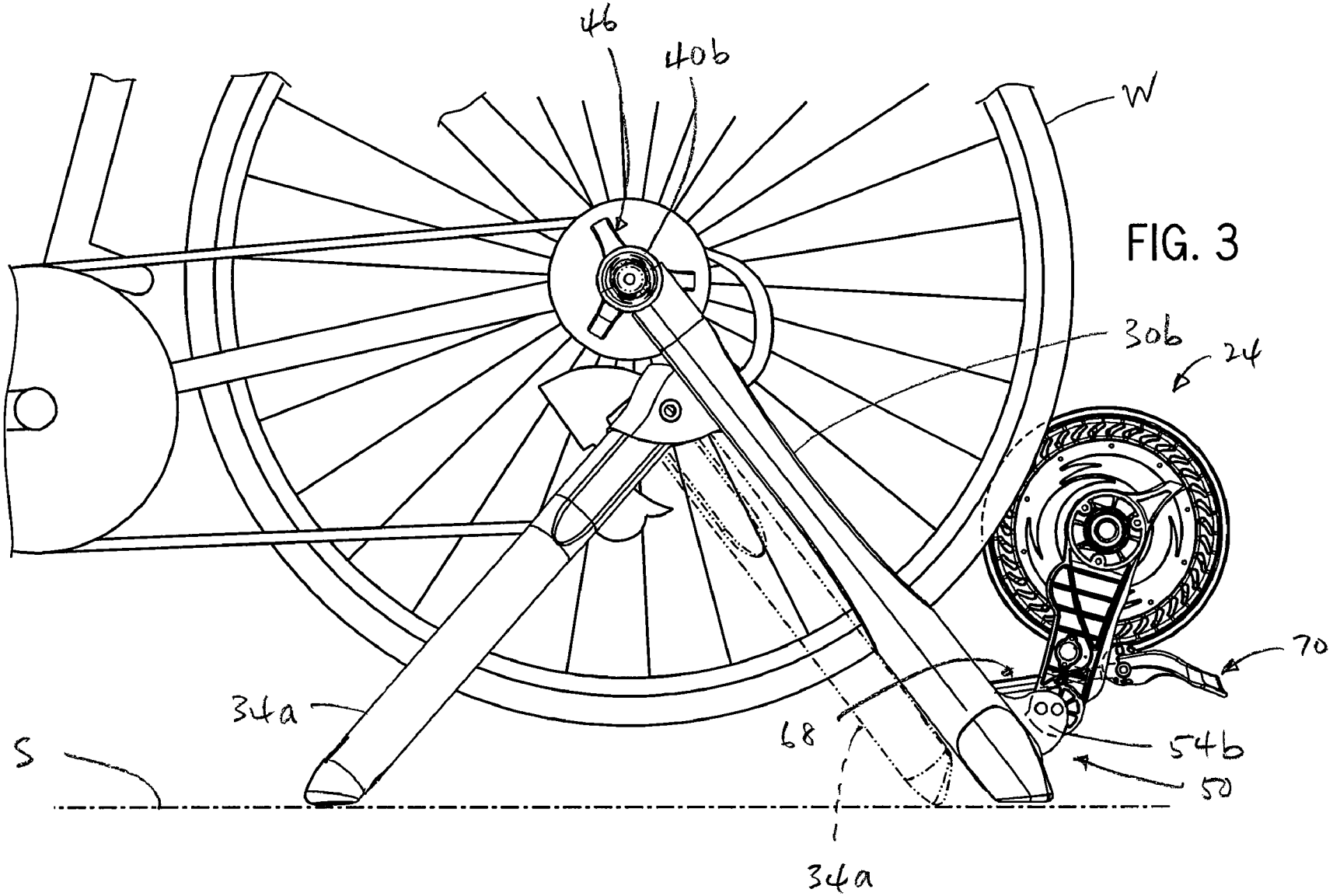
FIG. 3 is a side elevation view of the bicycle trainer or FIGS. 1 and 2.

Support arms 30*a*, 30*b* include a wheel mounting arrangement that enables a bicycle wheel W to be secured to frame 22 of trainer 20 such that a bicycle wheel W is supported above support surface S, as shown in FIGS. 2 and 3. In the illustrated embodiment, the wheel mounting arrangement includes a pair of spaced apart, aligned tubular frame sections 40*a*, 40*b* secured to the upper ends of respective support arms 30*a*, 30*b*, and wheel engagement components interconnected with frame sections 40*a*, 40*b* for clamping bicycle wheel W therebetween. The wheel engagement components include a stationary wheel engagement member 42 secured to and extending inwardly from frame section 40*a*, and a movable wheel engagement member 44 secured to and extending inwardly from frame section 40*b*. As is explained more fully in copending application Ser. No. 12/116,007, filed May 6, 2008, the disclosure of which is hereby incorporated by reference, the movable wheel engagement member 44 is movable toward and away from the stationary wheel engagement member 42 in response to rotation of a rotatable actuator 46 interconnected with frame section 40*b*. In this manner, the stationary and movable wheel engagement members 42, 44, respectively, are engaged with the ends of the skewer of bicycle wheel W, as shown in FIG. 2, to clamp the skewer therebetween and to thereby rotatably secure the bicycle wheel W to the frame 22.

When the bicycle wheel W is secured to the frame 22 as shown and described, the resistance unit 24 may be moved into engagement with the wheel W so as to resist rotation of wheel W when wheel W is rotated in response to input power applied to the bicycle pedals by a user. The resistance unit 24 includes a roller 48 that is engaged with the tire of the bicycle wheel W, and typically includes a flywheel connected to roller 48 that is contained within a cover 50. As will be explained below, the resistance unit 24 is pivotably secured to base member 28 of frame 22 so as to be selectively movable toward wheel W for engagement with the tire of wheel W, and selectively movable away from wheel W out of engagement with the tire of wheel W.

Figure 4:
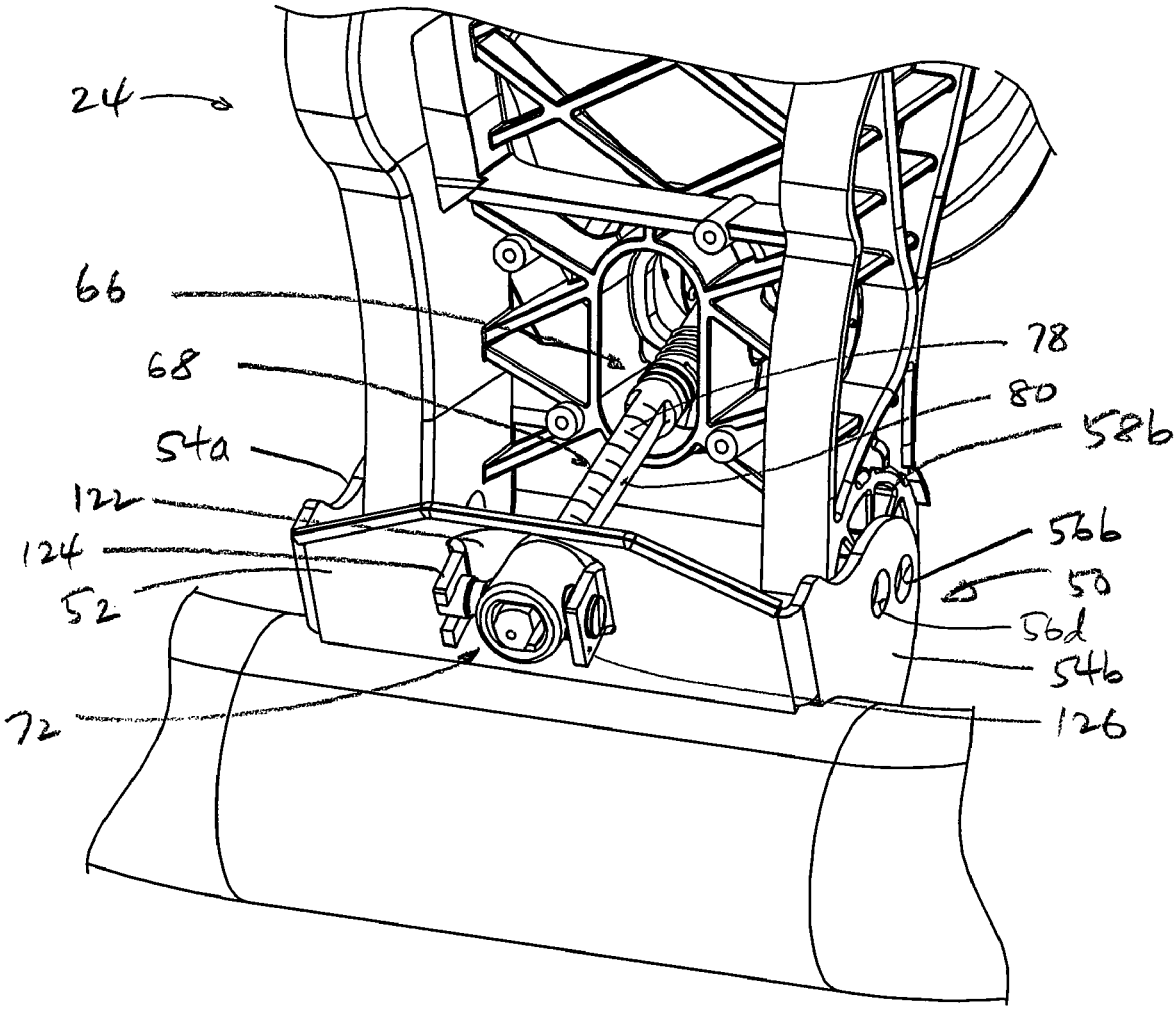
FIG. 4 is an enlarged partial isometric view of portion of the bicycle trainer of FIGS. 1-3, showing connection of the resistance unit to the frame of the bicycle trainer and the resistance unit adjustment arrangement of the present invention.
Figure 5:
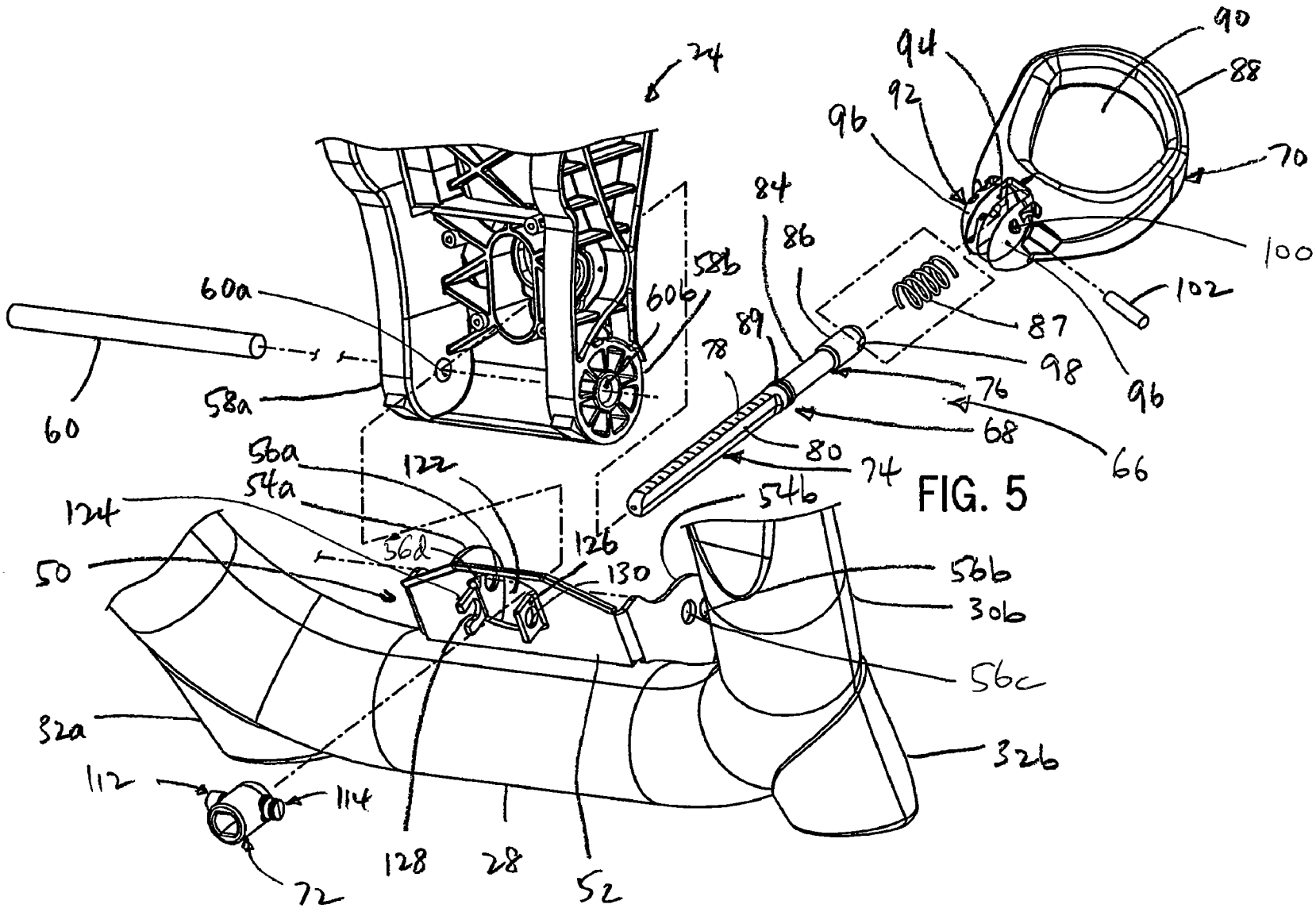
FIG. 5 is a partial exploded isometric view showing portions of the frame and resistance unit of the bicycle trainer as in FIG. 4, and showing the components of the resistance unit adjustment arrangement of the present invention.

Referring to FIGS. 3-5, the resistance unit 24 is movably mounted to frame 22 for movement toward and away from wheel W. Representatively, the resistance unit 24 may be mounted for pivoting movement to frame 22, although it is understood that any other type of movable connection of resistance unit 24 to frame 22 may be employed. In the illustrated embodiment, the resistance unit 24 is pivotably connected to a mounting bracket 50 that is secured to the base member 28 of frame 22 in any satisfactory manner, such as by welding. Mounting bracket 50 includes a transverse wall 52 and a pair of side walls 54*a* and 54*b* that extend rearwardly from transverse wall 52. Side walls 54*a*, 54*b* define respective openings 56*a*, 56*b* and 56*c*, 56*d*. The yoke of resistance unit 24 is configured to fit between side walls 54*a*, 54*b*, and defines a pair of mounting hubs 58*a*, 58*b* within which respective aligned passages 60*a*, 60*b* are formed. Mounting hubs 58*a*, 58*b* are adapted to be placed adjacent respective mounting bracket side walls 54*a*, 54*b* such that passages 60*a* and 60*b* are in alignment with either sidewall openings 56*a*, 56*b* or 56*c*, 56*d*, depending on the size of the bicycle wheel with which resistance unit 24 is to be engaged. A pivot pin or axle 60 extends through the aligned passages 60*a* and 60*b* and sidewall openings 56*a*, 56*b* or 56*c*, 56*d*, so as to pivotably secure resistance unit 24 to mounting bracket 50 for pivoting movement about a pivot axis defined by pivot axle 60.

Referring to FIGS. 4 and 5, a resistance unit adjustment arrangement 66 is interconnected between frame 22 and resistance unit 24. In the illustrated embodiment, the resistance unit adjustment arrangement 66 is interconnected with frame 22 by engagement with transverse wall 52 of mounting bracket 50, although it is understood that resistance unit adjustment arrangement 66 may be connected between resistance unit 24 and any part of frame 22. In a manner to be explained, resistance unit adjustment arrangement 66 is operable in an engaged position to adjust the position of resistance unit 24 throughout a range of operative positions for engagement with the tire of varying sizes of wheels W, and is also movable to an inoperative position to enable the resistance unit 24 to be moved to a collapsed or folded position for storage or shipment. In addition, when adjustment arrangement 66 is in the operative position, adjustment arrangement 66 is operable in a first mode of operation, e.g. by rotatable movement, to move resistance unit 24 through the range of operative positions for positioning the resistance unit 24 adjacent the tire of wheel W. Adjustment arrangement 66 is also operable in a second mode of operation, e.g. by cam-type movement, to move the resistance unit 24 toward and against the bicycle wheel.

The resistance unit adjustment arrangement 66 generally includes an elongated adjustment member 68 interconnected with resistance unit 24, to which a handle 70 is connected, in combination with an engagement member 72 interconnected with frame 22 through mounting bracket 50.

Figure 9:
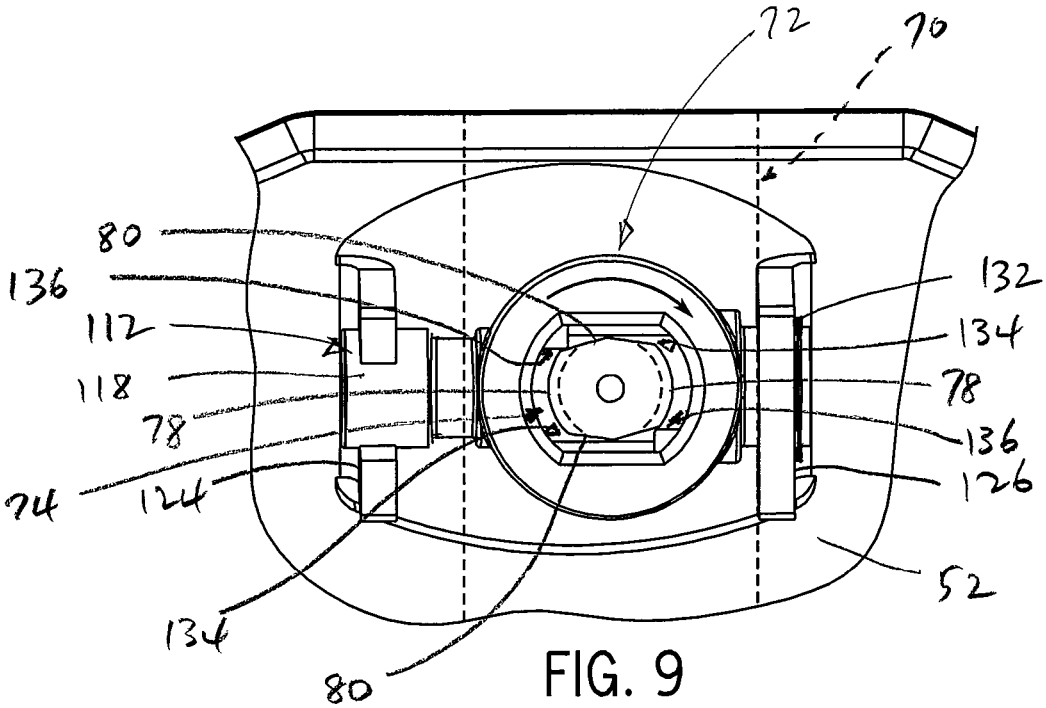
FIG. 9 is a partial end elevation view with reference to line 9-9 of FIG. 8.
Figure 11:
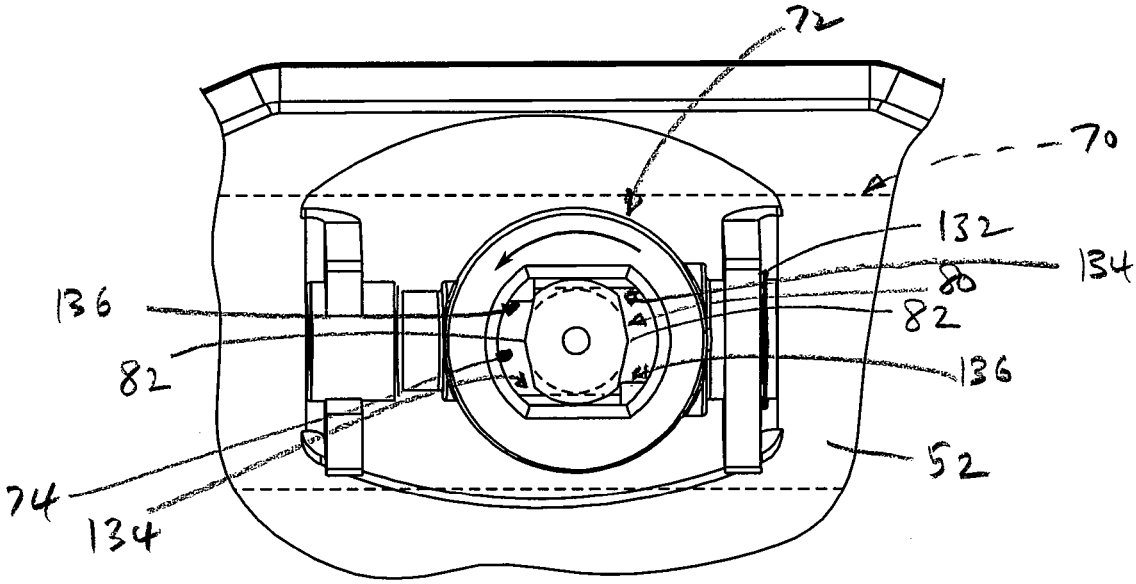
FIG. 11 is a partial end elevation view with reference to line 11-11 of FIG. 10.

Elongated adjustment member 68 includes a specially configured distal shank section 74 and a proximal handle mounting section 76. The distal shank section 74 is formed with a pair of oppositely facing threaded areas 78, which are separated by a pair of oppositely facing unthreaded areas 80. The threaded areas 78 are arcuate in shape, and the threads of the threaded areas 78 are continuous between the threaded areas 78. The unthreaded areas 80 are each formed to define a slight peak 82, as shown in FIGS. 9 and 11.

Referring to FIG. 5, handle mounting section 76 of adjustment member 68 includes a reduced diameter portion 84, which is located between the proximal end of shank section 74 and a head portion 86 located at the proximal end of adjustment member 68. A spring 87 is secured to adjustment member 68. One end of spring 87 bears against a shoulder 89 located at the distal end of reduced diameter portion 84. The opposite end of spring 87 bears against resistance unit 24, so that spring 87 functions to bias adjustment member 68 outwardly relative to resistance unit 24.

Handle 70 includes a manually engageable outer end actuator portion 88 which defines an opening 90, in combination with an inner mounting portion 92. The inner mounting portion 92 defines an arcuate slot 94, within which the head portion 86 of adjustment member 68 is received. Inner mounting portion 92 is formed with spherical cam surfaces 96 on either side of slot 94. Mounting portion 92 is offset relative to actuator portion 88, such that cam surfaces 96 extend outwardly from one side of handle 70 relative to the opposite side.

Figure 10:
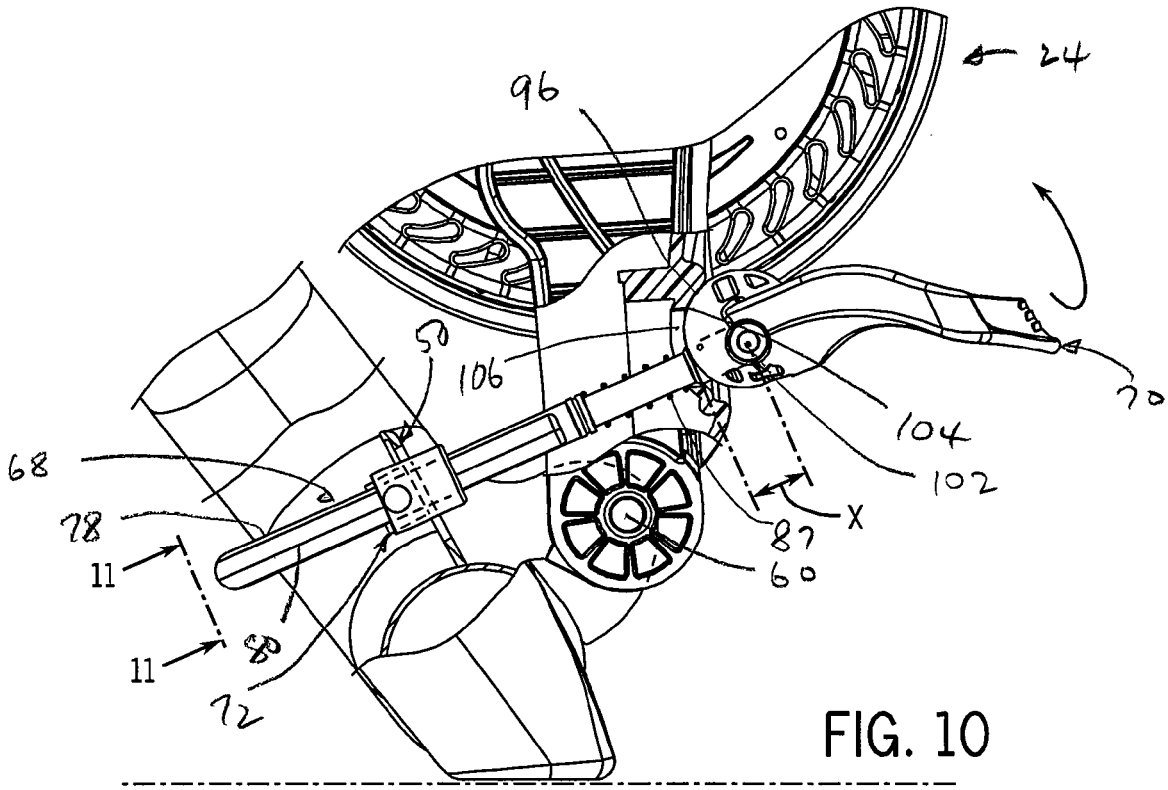
FIG. 10 is a partial side elevation view similar to FIG. 8, showing the elongated adjustment member incorporated in the resistance unit adjustment arrangement in an engaged position, to retain the resistance unit adjacent the bicycle wheel.

The head portion 86 of adjustment member 68 is rounded, and includes a transverse passage 98. The mounting portion 92 of handle 70 is formed with a transverse passage 100, which extends laterally outwardly from either side of slot 94. When head portion 86 of adjustment member 68 is received within slot 94, passage 98 in head portion 86 is aligned with passage 100. A pivot pin 102 is inserted through the aligned passages 98, 100, so as to pivotably secure mounting portion 92 of handle 70 and head portion 86 of elongated adjustment member 68 together for movement about a pivot axis defined by pivot pin 102. As shown in FIG. 10, the pivot axis defined by pivot pin 102 is offset relative to the center of the spherical cam surfaces 96 of mounting portion 92.

Figure 7:
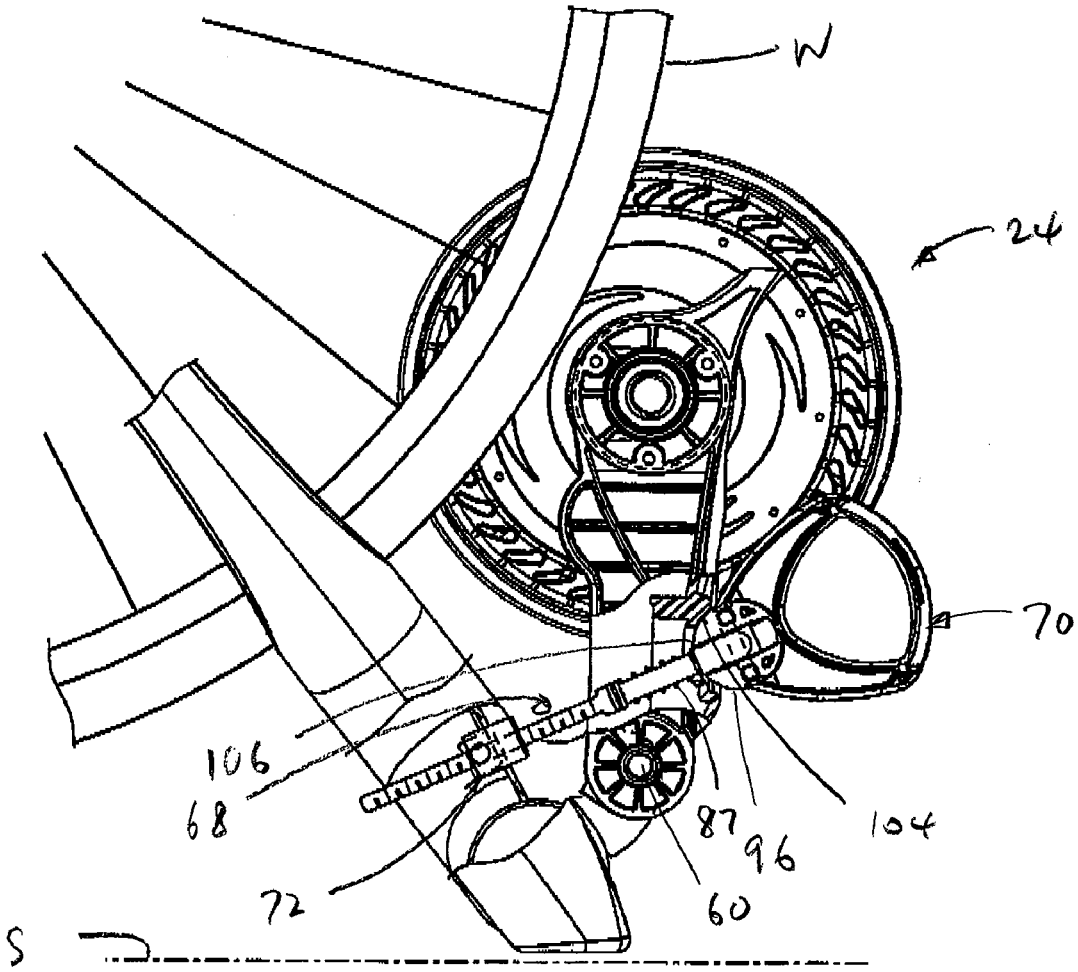
FIG. 7 is a partial side elevation view, with portions in section, showing the resistance unit adjustment arrangement of FIGS. 4 and 5 in a position in which the resistance unit is moved into engagement with the wheel of a bicycle.
Figure 8:
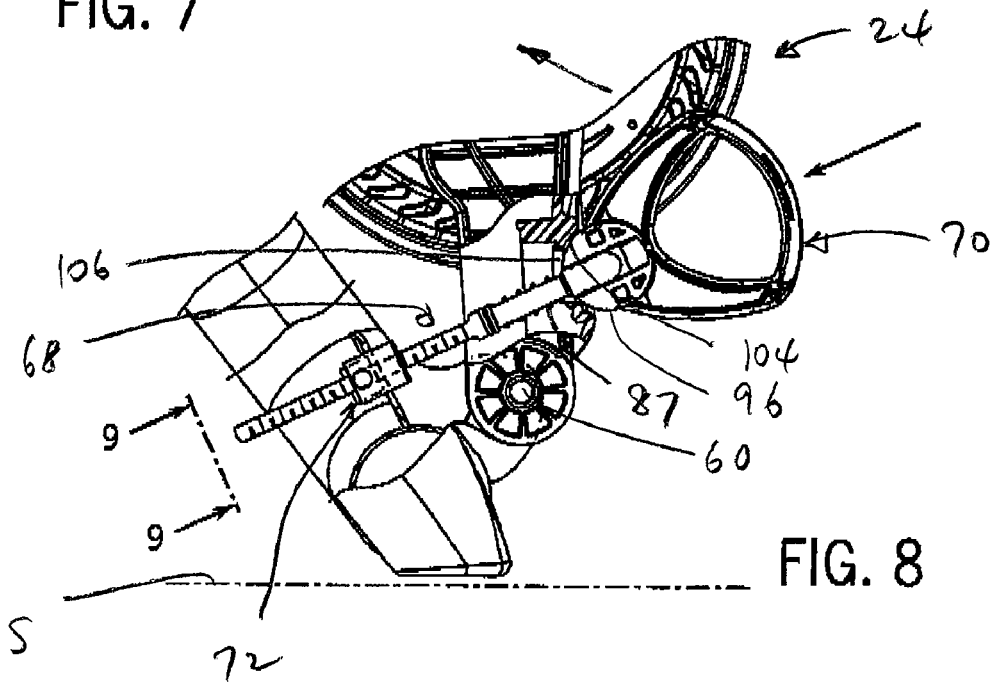
FIG. 8 is a partial side elevation view similar to FIG. 7, with portions in section, in which an elongated adjustment member incorporated in the resistance unit adjustment arrangement is in a disengaged position to provide sliding movement of the elongated adjustment member relative to an engagement member incorporated in the resistance unit adjustment arrangement, to enable movement of the resistance unit through the range of operative positions.
Figure 12:
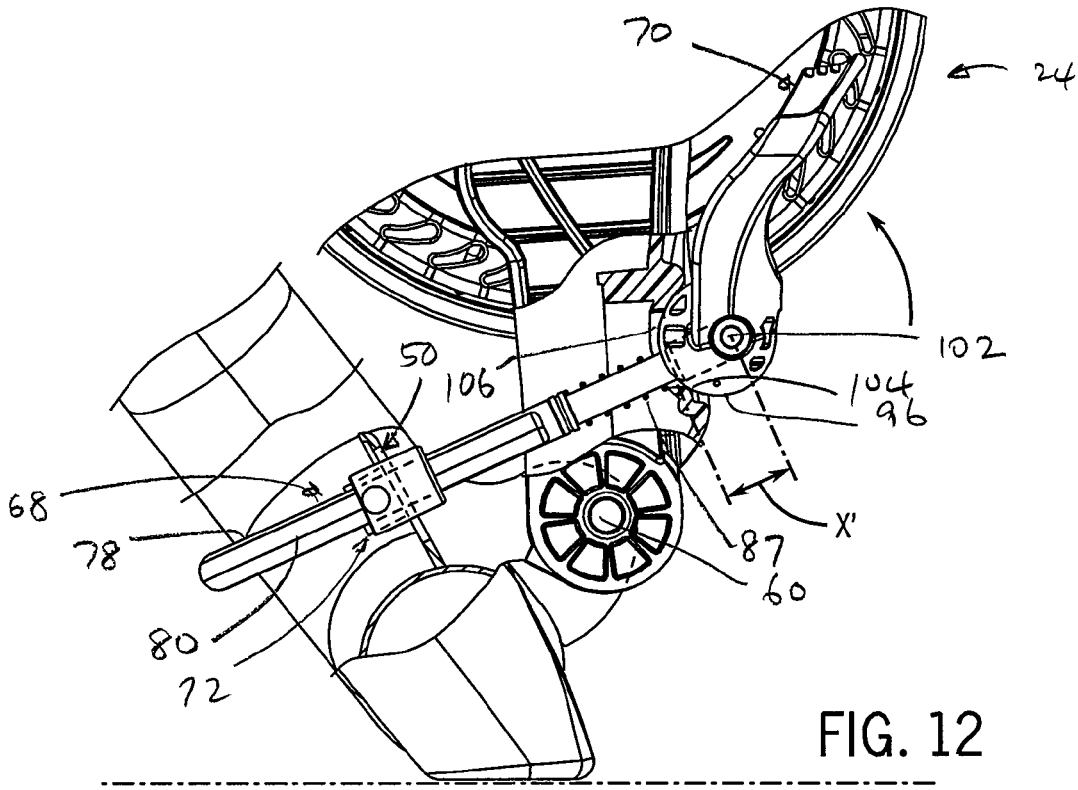
FIG. 12 is a view similar to FIG. 10, showing operation of the resistance unit adjustment arrangement in a second mode of operation for moving the resistance unit toward and against the bicycle wheel.

As shown in FIGS. 7 and 10, the yoke of resistance unit 24 includes an arcuate seat area 104 within which a slot 106 is formed. Elongated adjustment member 68 extends through slot 106. The outer end of spring 87 bears against the inside surface of seat area 104 at slot 106, so as to bias cam surfaces 96 of mounting portion 92 into engagement with seat area 104. The seat area 104 has a radius that matches that of spherical cam surfaces 96 of mounting portion 92, which enables mounting portion 92 to be seated within seat area 104 as shown in FIGS. 8, 10 and 12. Seat area 104 is offset from the pivot axis defined by axle 60, which pivotably secures resistance unit 24 to mounting bracket 50.

Figure 6:
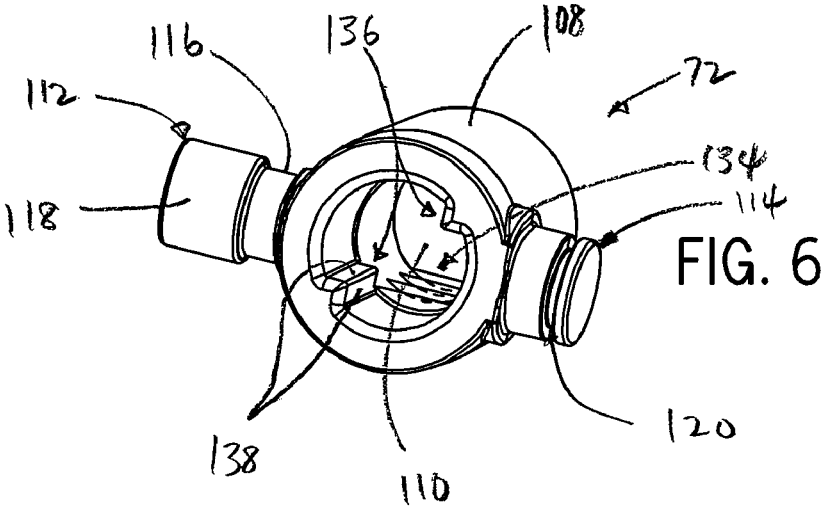
FIG. 6 is an isometric view showing a threaded engagement member incorporated in the resistance unit adjustment arrangement of the present invention as shown in FIGS. 4 and 5.

Referring to FIGS. 4 and 6, engagement member 72 is in the form of a generally cylindrical member defining a body 108 having an axial passage 110. A pair of mounting bosses 112, 114 extend outwardly from body 108 in opposite directions along a common transverse axis. Boss 112 defines a reduced diameter neck 116 and an outer engagement area 118 having a circular cross section. Boss 114 also is formed with a circular cross section, and includes an annular groove 120 located toward its outer end.

Transverse wall 52 of mounting bracket 50 is formed so as to define an opening 122 through with elongated adjustment member 68 extends for engagement with engagement member 72, in a manner to be explained. A pair of mounting tabs 126 are provided on transverse wall 52 on either side of opening 122. Representatively, mounting tabs 124, 126 may be formed of the material of transverse wall 52 that is removed to form opening 122, such as in a stamping and bending process, although it is understood that any other satisfactory means of connection may be employed. Mounting tab 124 is formed with an opening 128 and mounting tab 126 is formed with an opening 130. Opening 128 in mounting tab 124 is generally circular, and is formed so as to define a restricted entrance area that extends to the front edge of the mounting tab 124. Opening 130 in mounting tab 126 is generally circular.

Engagement member 72 is pivotably mounted to frame 22 by engagement with mounting tabs 124, 126, for movement about a transverse pivot axis defined by bosses 112, 114. To accomplish this, engagement member 72 is positioned between mounting tabs 124, 126 by aligning neck 116 of boss 112 with the restricted entrance area of opening 128, and then advancing engagement member 72 so as to position neck 116 in opening 128. Boss 114 has a length that enables the end of boss 114 to be located inwardly of mounting tab 126 when engagement member 72 is moved between mounting tabs 124, 126 in this manner. Engagement member 72 is then moved laterally, in a direction toward support arm 30*b*, which moves boss 114 into opening 130 in mounting tab 126, and moves the engagement area 118 of boss 112 into opening 128 in mounting tab 124. When engagement member 72 is positioned in this manner relative to mounting tabs 124, 126, the restricted entrance area of opening 128 maintains engagement area 118 of boss 112 in opening 128, and groove 120 in boss 114 is located outwardly of the outer surface of mounting tab 126. A retainer, such as a snap ring 132 (FIGS. 9 and 10) is then engaged with groove 120 in boss 114. The snap ring 132 prevents disengagement of boss 114 from opening 130 when engagement member is moved laterally toward support arm 30*a*, so as to capture engagement member 72 between mounting tabs 124, 126. With this arrangement, engagement member 72 is pivotably secured to mounting bracket 50 for movement about a transverse pivot axis defined by the coaxial bosses 112, 114.

It should be understood that the illustrated and described pivot connection of engagement member 72 with mounting bracket 50 is representative of any number of different ways by which engagement member 72 may be pivotably interconnected with frame 22.

Referring to FIGS. 6, 9 and 10, the passage 110 in body 108 of engagement member 72 has specially configured structure that provides selective engagement and disengagement between elongated adjustment member 68 and engagement member 72. In this regard, the proximal area of passage 110 includes diametrically opposed, facing thread sections 134, which are configured for engagement with the threaded areas 78 of adjustment member 68. The distal area of passage 110 includes diametrically opposite, pointed stops 136, each of which is defined by a pair of planar convergent surfaces 138 (although it is understood that the stops may have any other desired configuration).

In operation, resistance unit adjustment arrangement 66 functions as follows to provide movement of resistance unit 24 relative to frame 22.

Referring to FIGS. 1 and 7, when bicycle wheel W is first mounted to frame 22, resistance unit 24 is in a position spaced from bicycle wheel W. To engage the resistance unit 24 with the wheel W, the user first place adjustment member 68 in the disengaged position, which is shown in FIGS. 8 and 9. When adjustment member 68 is in the disengaged position, the threads 78 of the adjustment member shank 74 are moved out of engagement with the thread sections 134 of the engagement member 72. The unthreaded areas 80 of the adjustment member 68 are positioned so as to face thread sections 134, so that adjustment member 68 is disengaged from engagement member 72 to provide a sliding connection between adjustment member 68 and engagement member 72. The user can then manually move resistance unit 24 toward bicycle wheel W, and adjustment member 68 slides within the passage 110 of engagement member 72 during such movement of resistance unit 24. Movement of resistance unit 24 can be accomplished either by manually engaging resistance unit 24 itself, or by grasping handle 70 and applying a pushing force on handle 70. Since cam surfaces 96 of mounting portion 92 are engaged with seat area 104 of the yoke of resistance unit 24, the application of a pushing force on handle 70 is transferred to the yoke of resistance unit 24, to advance resistance unit 24 toward bicycle wheel W. The pivoting movement of resistance 24 is accommodated in a number of ways by adjustment arrangement 66. First, as resistance unit 24 is pivoted, engagement member 72 is allowed to pivot relative to mounting bracket 50 about the transverse pivot axis defined by bosses 112 and 114. In addition, the spherical mating configuration of cam surfaces 96 and seat area 104 accommodates relative movement between handle 70 and resistance unit 24. Furthermore, adjustment member 66 moves within slot 106 to accommodate relative movement between resistance unit 24 and adjustment member 68.

When the resistance unit 24 is moved to a desired position adjacent wheel W, which may be a position in which the resistance unit roller 48 comes into initial contact with the tire of wheel W, the user rotates handle 70 as shown in FIGS. 10 and 12, which places adjustment arrangement 66 in an engaged configuration. Such rotation of handle 70 functions to rotate the adjustment member 68, which causes the threaded areas 78 of adjustment member 68 to move into engagement with the thread sections 134 of engagement member 72, as shown in FIG. 11. The stops 134 function to control or limit the rotation of adjustment member 68 relative to engagement member 72. That is, as adjustment member 68 is rotated relative to engagement member 72, the threaded areas 78 of the adjustment member 72 come into contact with the stops 134, which are configured to limit rotation of adjustment member 68 to either the disengaged position as shown in FIG. 9, or the engaged position as shown in FIG. 11. It can thus be appreciated that adjustment member 68 is only movable ninety degrees between the engaged and disengaged positions (although it is understood that adjustment member 98 is not limited to ninety degree rotation, and that any other satisfactory range of rotation of adjustment member 68 may be employed).

When adjustment member 68 is in the engaged position, the engagement of threaded areas 78 of adjustment member 68 with thread sections 134 of engagement member 72 function to prevent axial movement between adjustment member 68 and engagement member 72. The user then pivots handle 70 in an upward direction about pivot pin 102, as shown in FIG. 12. Such pivoting movement of handle 70 functions to apply a cam-type force against the yoke of resistance unit 24, which moves resistance unit 24 toward and against the tire of bicycle wheel W. The cam-type force is applied by cam surfaces 96 of handle mounting portion 92 acting against the mating spherical surface of seat area 104, and is caused by the offset relationship between the pivot axis defined by pivot pin 102 and the radial center of the spherical cam surfaces 96. In this manner, resistance unit 24 is advanced a predetermined distance toward and into engagement with the bicycle wheel W. When the tire of bicycle wheel W is maintained at a constant predetermined pressure, this predetermined movement of resistance unit 24 creates consistency in the pressure applied to be tire of wheel W by the resistance unit 24.

The adjustment arrangement 66 as shown and described provides one-handed operation, in that the user is able to grasp the handle 70 and initially place adjustment member 68 in the disengaged position by rotating handle 70, push the resistance unit 24 toward and into initial engagement with the tire of bicycle wheel W using the handle 70, rotate the handle 70 to place the adjustment member 68 in the engaged position, and then pivot the handle 70 so as to cam the resistance unit toward and against the tire of bicycle wheel W.

Figure 13:
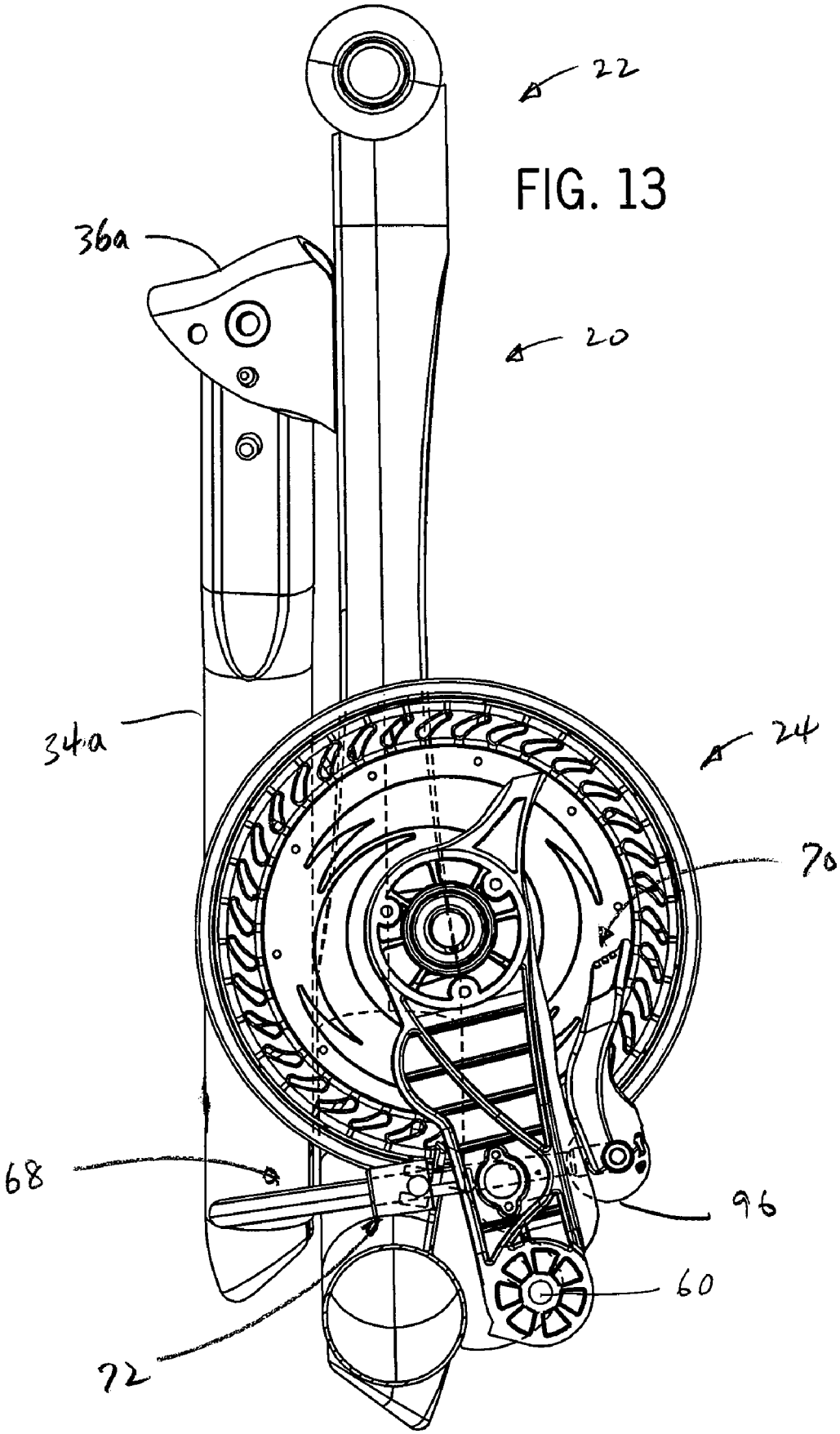
FIG. 13 is a section view showing the bicycle trainer in a folded configuration.

FIG. 13 illustrates bicycle trainer 20 in a folded configuration. In this configuration, legs 34*a*, 34*b* are folded against the respective support arms 30*a*, 30*b* by pivoting movement about pivot pins 38*a*, 38*b*. Resistance unit 24 is pivoted about pivot axle 62 to an inoperative position, in which resistance unit 24 is positioned between support arms 30*a* and 30*b* of frame 22. Again, such movement of resistance unit 24 is accomplished by placing adjustment member 68 in the disengaged position, and then pivoting resistance unit 24 either by manual engagement of resistance unit 24 or by pushing on handle 70. When resistance in 24 is placed in the inoperative position, the user then rotates handle 70 to place adjustment member 68 in the engaged position, and pivots handle 70 upwardly. While this causes cam-type movement of resistance in 24, such movement is relatively small and the general purpose of pivoting handle 70 is to position handle 70 so that it does not protrude outwardly. In this manner, bicycle trainer 22 can be folded to a compact configuration for shipment or storage. In addition, bicycle trainer 22 can be fully assembled at the point of manufacture, and then shipped as an assembly to the users so that no on-site assembly is required.

Various alternatives and embodiments are contemplated as being within the scope of the following claims particularly pointing out and distinctly claiming the subject matter regarded as the invention.

We claim:

1. A bicycle trainer for use with a bicycle having a driven wheel, comprising:

a frame;

a resistance unit movably interconnected with the frame, wherein the resistance unit is movable through a range of operative positions relative to the frame for engagement with the wheel, and is also movable relative to the frame to an inoperative position;

a manually operable resistance unit adjustment arrangement interposed between the resistance unit and the frame, wherein the adjustment arrangement includes an engagement member and an elongated adjustment member that is selectively engageable with the engagement member, wherein the elongated adjustment member and the engagement member are interconnected with the resistance unit and with the frame, and wherein the adjustment arrangement includes a handle, wherein the adjustment arrangement is movable by operation of the handle to a disengaged configuration in which the elongated adjustment member is disengaged from the engagement member to provide movement of the resistance unit throughout the range of operative positions, and is also operable in the disengaged configuration to enable movement of the resistance unit to and from the inoperative position, and wherein the adjustment arrangement is movable to an engaged configuration in which the elongated adjustment member is engaged with the engagement member to selectively maintain the resistance unit in a position within the range of operative positions and also to selectively maintain the resistance unit in the inoperative position.

2. The bicycle trainer of claim 1, wherein the resistance unit is movably interconnected with the frame via a pivot connection interposed between the resistance unit and the frame.

3. The bicycle trainer of claim 2, wherein the elongated adjustment member and the engagement member are interconnected between the resistance unit and the frame at a location spaced from the pivot connection.

4. A bicycle trainer for use with a bicycle having a driven wheel, comprising:

a frame;

a resistance unit movably interconnected with the frame via a pivot connection interposed between the resistance unit and the frame, wherein the resistance unit is movable through a range of operative positions relative to the frame for engagement with the wheel, and is also movable relative to the frame to an inoperative position;

a manually operable resistance unit adjustment arrangement interposed between the resistance unit and the frame, wherein the adjustment arrangement includes an elongated adjustment member interconnected between the resistance unit and the frame at a location spaced from the pivot connection, and wherein the adjustment arrangement in a disengaged configuration is operable by a user to move the resistance unit throughout the range of operative positions, and is also operable in the disengaged configuration to enable movement of the resistance unit to and from the inoperative position, and wherein the adjustment arrangement includes an engagement means for selectively maintaining the resistance unit in a position within the range of operative positions and also to selectively maintain the resistance unit in the inoperative position, wherein the engagement means includes an engagement member, wherein the elongated adjustment member is selectively engageable with the engagement member when the adjustment arrangement is in the engaged configuration, and is disengaged from the engagement member when the adjustment arrangement is in the disengaged configuration, wherein the engagement member is pivotably interconnected with one of the resistance unit or the frame for movement about a pivot axis oriented transverse to a longitudinal axis along which the elongated adjustment member extends, wherein the elongated adjustment member is interconnected with the other of the resistance unit or the frame.

5. The bicycle trainer of claim 4, wherein the elongated adjustment member and the engagement member include threaded areas, wherein the threaded areas of the elongated adjustment member are disengaged from the threaded areas of the engagement member in order to place the adjustment arrangement in the disengaged configuration so as to enable the elongated adjustment member to be moved axially relative to the engagement member without threaded engagement between the threaded areas of the elongated adjustment member and the engagement member.

6. The bicycle trainer of claim 2, wherein the adjustment arrangement is operable in a first mode of operation by axial movement of the elongated adjustment member relative to the engagement member to move the resistance unit to an initial engagement position adjacent the wheel, and is operable in a second mode of operation by pivoting movement of the handle relative to the elongated adjustment member to advance the resistance unit from the initial engagement position toward and against the wheel via cam-type engagement between the handle and the resistance unit.

7. A bicycle trainer for use with a bicycle having a driven wheel, comprising:

a frame;

a resistance unit movably interconnected with the frame via a pivot connection interposed between the resistance unit and the frame, wherein the resistance unit is movable through a range of operative positions relative to the frame for engagement with the wheel, and is also movable relative to the frame to an inoperative position;

a manually operable resistance unit adjustment arrangement interposed between the resistance unit and the frame, wherein the adjustment arrangement in a disengaged configuration is operable by a user to move the resistance unit throughout the range of operative positions, and is also operable in the disengaged configuration to enable movement of the resistance unit to and from the inoperative position, and wherein the adjustment arrangement includes engagement means for selectively maintaining the resistance unit in a position within the range of operative positions and also to selectively maintain the resistance unit in the inoperative position, wherein the adjustment arrangement is operable in a first mode of operation to position the resistance unit in an initial engagement position adjacent the wheel, and is operable in a second mode of operation to advance the resistance unit from the initial engagement position toward and against the wheel, wherein the adjustment arrangement includes an elongated adjustment member and an engagement member, wherein the elongated adjustment member includes a handle and is interconnected between the resistance unit and the frame at a location spaced from the pivot connection, wherein the elongated adjustment member is engaged with the engagement member when the adjustment arrangement is in an engaged configuration, and is disengaged from the engagement member when the adjustment arrangement is in the disengaged configuration, wherein the first mode of operation comprises threaded engagement between the elongated adjustment member and the engagement member, and wherein the second mode of operation comprises a cam arrangement interposed between the handle and the resistance unit for advancing the resistance unit toward the wheel in response to movement of the handle relative to the elongated adjustment member.

8. A bicycle trainer for use with a bicycle having a driven wheel, comprising:

frame means for engagement with a support surface;

resistance means movably interconnected with the frame means for engagement with the wheel to resist rotation of the wheel, wherein the resistance means is movable through a range of operative positions relative to the frame means for engagement with the wheel, and is also movable relative to the frame means to an inoperative position;

resistance unit adjustment means interposed between the resistance means and the frame means for providing movement of the resistance means relative to the frame means, wherein the adjustment means includes an engagement member and an elongated adjustment member that is selectively engageable with the engagement member, wherein the elongated adjustment member and the engagement member are interconnected with the resistance means and with the frame means, and wherein the adjustment means includes a handle, wherein the adjustment means is movable by operation of the handle to a disengaged configuration in which the resistance means is movable throughout the range of operative positions by relative axial movement between the elongated adjustment member and the engagement member, and in the disengaged configuration is also operable to enable movement of the resistance means to the inoperative position, and wherein the adjustment means includes engagement means that is operable by movement of the handle for selectively fixing axial position of the elongated adjustment member relative to the engagement member and to thereby maintain the resistance unit in a position within the range of operative positions and also to selectively maintain the resistance unit in the inoperative position.

9. The bicycle trainer of claim 8, further comprising cam means disposed between the resistance means and the handle, wherein the cam means is operable by pivoting movement of the handle relative to the elongated adjustment member to advance the resistance means about the pivot connection toward and against the wheel.

10. A method of altering the configuration of a bicycle trainer that includes a frame and a resistance unit that is engageable with a wheel of a bicycle, the method comprising:

providing the bicycle trainer in a configuration in which the resistance unit is movably connected to the frame and in an inoperative position relative to the frame;

moving the resistance unit relative to the frame from the inoperative position to a first operative position; and moving the resistance unit relative to the frame from the first operative position to a second operative position using a resistance unit adjustment arrangement that is interconnected between the frame and the resistance unit, wherein the resistance unit adjustment arrangement includes an elongated adjustment member and an engagement member interconnected between the resistance unit and the frame, and further comprising a handle interconnected with the elongated adjustment member;

wherein the resistance unit adjustment arrangement is positioned in a first configuration by operation of the handle, in which the elongated adjustment member is engaged with the engagement member, for enabling movement of the resistance unit from the first operative position to the second operative position, and is positioned in a second configuration by operation of the handle, in which the elongated adjustment member is disengaged from the engagement member, for enabling movement of the resistance unit from the inoperative position to the first operative position and from the second operative position to the inoperative position.

11. The method of claim 10, wherein moving the resistance unit relative to the frame is carried out by means of a pivot connection that provides pivoting movement of the resistance unit relative to the frame.

12. A method of altering a configuration of a bicycle trainer that includes a frame and a resistance unit that is engageable with a wheel of a bicycle, the method comprising:

providing the bicycle trainer in a configuration in which the resistance unit is movably connected to the frame and in an inoperative position relative to the frame;

moving the resistance unit relative to the frame from the inoperative position to a first operative position;

moving the resistance unit relative to the frame from the first operative position to a second operative position using a resistance unit adjustment arrangement that is interconnected between the frame and the resistance unit;

wherein the resistance unit adjustment arrangement is positioned in a first configuration for enabling movement of the resistance unit from the first operative position to the second operative position, and is positioned in a second configuration for enabling movement of the resistance unit from the inoperative position to the first operative position and from the second operative position to the inoperative position;

wherein moving the resistance unit relative to the frame is carried out by means of a pivot connection that provides pivoting movement of the resistance unit relative to the frame; and wherein the adjustment arrangement comprises a combination threaded and slidable adjustment mechanism interposed between the frame and the resistance unit at a location spaced from the pivot connection, and which includes an elongated adjustment member and an engagement member, wherein the adjustment arrangement in the engaged configuration provides threaded engagement between the elongated adjustment member and the engagement member to prevent movement of the resistance unit relative to the frame, and wherein the adjustment arrangement in the disengaged configuration disengages the threaded engagement between the elongated adjustment member and the engagement member to move the resistance unit relative to the frame in response to sliding movement between the elongated adjustment member and the engagement member.

13. The method of claim 11, including moving the resistance unit relative to the frame from the disengaged position to an initial position adjacent the wheel by operation of the resistance unit adjustment arrangement in a first mode of operation, and moving the resistance unit relative to the frame from the initial position to an operative engaged position toward and against the wheel by operation of the resistance unit adjustment mechanism in a second mode of operation different than the first mode of operation.

14. A method of altering a configuration of a bicycle trainer that includes a frame and a resistance unit that is engageable with a wheel of a bicycle, the method comprising:

providing the bicycle trainer in a configuration in which the resistance unit is movably connected to the frame and in an inoperative position relative to the frame;

moving the resistance unit relative to the frame from the inoperative position to a first operative position adjacent the bicycle wheel;

moving the resistance unit relative to the frame from the first operative position to a second operative position into engagement with the bicycle wheel using a resistance unit adjustment arrangement that is interconnected between the frame and the resistance unit;

wherein the resistance unit adjustment arrangement is positioned in a first configuration and is operable in a first mode of operation for enabling movement of the resistance unit from the inoperative position to the first operative position, and is positioned in a second configuration and is operable in a second mode of operation different than the first mode of operation for enabling movement of the resistance unit from the first operative position to the second operative position, and is positioned in the first configuration and is operable in the first mode of operation for enabling movement of the resistance unit from the second operative position to the inoperative position;

wherein moving the resistance unit relative to the frame is carried out by means of a pivot connection that provides pivoting movement of the resistance unit relative to the frame; and wherein the adjustment arrangement comprises a combination threaded and slidable adjustment mechanism interposed between the frame and the resistance unit at a location spaced from the pivot connection, and which includes an engagement member and an elongated adjustment member having a pivotable handle, wherein the adjustment arrangement is movable to an engaged configuration when in the first operative position to provide threaded engagement between the elongated adjustment member and the engagement member to prevent movement of the resistance unit relative to the frame, and wherein the adjustment arrangement is movable to a disengaged configuration when in the inoperative position and when in the second operative position to disengage the threaded engagement between the elongated adjustment member and the engagement member to move the resistance unit relative to the frame in response to sliding movement between the elongated adjustment member and the engagement member, wherein the first mode of operation comprises sliding movement between the elongated adjustment member and the engagement member when the adjustment arrangement is in the disengaged configuration, and wherein the second mode of operation comprises a cam-type movement of the resistance unit relative to the frame when the adjustment arrangement in the engaged configuration in response to pivoting movement of the handle relative to the elongated adjustment member.

15. A bicycle trainer for use with a bicycle having a driven wheel, comprising:

a frame;

a resistance unit movably interconnected with the frame, wherein the resistance unit is movable through a range of operative positions relative to the frame in response to a manually operable resistance unit adjustment arrangement interposed between the resistance unit and the frame, wherein the adjustment arrangement includes an engagement member and an elongated adjustment member that is selectively engageable with the engagement member, wherein the elongated adjustment member and the engagement member are interconnected with the resistance unit and with the frame, and wherein the elongated adjustment member includes a handle;

wherein the adjustment arrangement is operable in a first mode of operation by relative axial movement between the elongated adjustment member and the engagement member to move the resistance unit to an initial engagement position adjacent the wheel, wherein the elongated adjustment member is engaged with the engagement member by operation of the handle to maintain the resistance unit in the initial engagement position, and is operable in a second mode of operation by cam-type engagement of the handle with the resistance unit in response to pivoting movement of the handle relative to the elongated adjustment member, to advance the resistance unit from the initial engagement position toward and against the wheel.

16. The bicycle trainer of claim 15, wherein the elongated adjustment member and the engagement member include a selectively engageable threaded connection that selectively prevents axial movement between the adjustment member and the engagement member, and a selectively positionable slidable connection that selectively allows axial movement between the elongated adjustment member and the engagement member.

17. A method of positioning a resistance unit of a bicycle trainer that includes a frame to which the resistance unit is mounted wherein the resistance unit is engageable with a wheel of a bicycle, the method comprising:

providing the bicycle trainer in a configuration in which the resistance unit is movably connected to the frame in an inoperative position;

moving the resistance unit relative to the frame from the inoperative position to an initial position adjacent the wheel by operation of a resistance unit adjustment arrangement in a first mode of operation, wherein the adjustment arrangement is interconnected between the frame and the resistance unit, and includes an elongated adjustment member and an engagement member, and a handle interconnected with the elongated adjustment member, and wherein the first mode of operation comprises axial movement of the elongated adjustment member relative to the engagement member;

engaging the elongated adjustment member with the engagement member by operation of the handle to prevent axial movement between the elongated adjustment member and the engagement member; and moving the resistance unit relative to the frame from the initial position to an operative engaged position toward and against the wheel by operation of the resistance unit adjustment arrangement in a second mode of operation different than the first mode of operation, wherein the second mode of operation comprises cam-type engagement between the handle and the resistance unit in response to pivoting movement of the handle relative to the elongated adjustment member.

18. A method of positioning a resistance unit of a bicycle trainer that includes a frame to which the resistance unit is mounted wherein the resistance unit is engageable with a wheel of a bicycle, the method comprising:

providing the bicycle trainer in a configuration in which the resistance unit is movably connected to the frame in an inoperative position;

moving the resistance unit relative to the frame from the inoperative position to an initial position adjacent the wheel by operation of a resistance unit adjustment arrangement in a first mode of operation, wherein the adjustment arrangement is interconnected between the frame and the resistance unit, and wherein the adjustment arrangement comprises an elongated adjustment member interconnected with one of the frame or the resistance unit and an engagement member interconnected with the other of the frame or the resistance unit, and wherein the adjustment arrangement in the first mode of operation is operable by a user to move the resistance unit throughout a range of initial positions;

moving the resistance unit relative to the frame from the initial position to an operative engaged position toward and against the wheel by operation of the resistance unit adjustment arrangement in a second mode of operation different than the first mode of operation, wherein the first mode of operation comprises a sliding connection between the elongated adjustment member and the engagement member to move the resistance unit throughout the range of initial positions by sliding movement between the elongated adjustment member and the engagement member, and further comprising an engagement arrangement between the elongated adjustment member and the engagement member to prevent movement of the resistance unit; and wherein the elongated adjustment member includes a pivotable handle that is used by a user to move the elongated adjustment member throughout the range of initial positions, and wherein the second mode of operation is carried out by pivoting the handle relative to the elongated adjustment member, wherein a cam-type connection is interposed between the handle and the resistance unit such that pivoting movement of the handle relative to the elongated adjustment member functions to force the resistance unit against the wheel to the operative engaged position.

19. The bicycle trainer of claim 3, wherein the engagement member is pivotably interconnected with one of the resistance unit or the frame for movement about a pivot axis oriented transverse to a longitudinal axis along which the elongated adjustment member extends, and wherein the elongated adjustment member is interconnected with the other of the resistance unit or the frame.

20. The bicycle trainer of claim 19, wherein the elongated adjustment member and the engagement member include threaded areas, wherein the threaded areas of the elongated adjustment member are disengaged from the threaded areas of the engagement member in order to place the adjustment arrangement in the disengaged configuration so as to enable the elongated adjustment member to be moved axially relative to the engagement member without threaded engagement between the threaded areas of the elongated adjustment member and the engagement member.

21. The bicycle trainer of claim 1, further comprising a cam arrangement interposed between the handle and the resistance unit for advancing the resistance unit toward the wheel in response to pivoting movement of the handle relative to the elongated adjustment member.

22. The method of claim 10, including moving the resistance unit from the first operative position to the second operative position by operation of a cam arrangement interposed between the handle and the resistance unit upon pivoting movement of the handle relative to the elongated adjustment member.

* * * * *